US006566285B1

(12) United States Patent
Morris et al.

(10) Patent No.: US 6,566,285 B1
(45) Date of Patent: May 20, 2003

(54) INTERLINING MATERIAL, PROCESS OF MANUFACTURING AND USE THEREOF

(75) Inventors: Paul Morris, Rawdon Leeds (GB); Michael Horsfield, Bardsey Leeds (GB)

(73) Assignee: Pro-fit International Limited, Horsforth Leeds (GB)

( * ) Notice: Subject to any disclaimer, the term of this patent is extended or adjusted under 35 U.S.C. 154(b) by 0 days.

(21) Appl. No.: 09/673,229

(22) PCT Filed: Apr. 14, 1999

(86) PCT No.: PCT/GB99/01146

§ 371 (c)(1), (2), (4) Date: Jan. 5, 2001

(87) PCT Pub. No.: WO99/52386

PCT Pub. Date: Oct. 21, 1999

(30) Foreign Application Priority Data

Apr. 15, 1998 (GB) ..... 9807861

(51) Int. Cl.[7] ..... D03D 17/00; D03D 15/08; B23B 5/24; B23B 5/26

(52) U.S. Cl. ..... 442/184; 442/182; 442/183; 442/328; 442/329; 442/366

(58) Field of Search ..... 2/221; 442/182–184, 442/328, 329, 366

(56) References Cited

U.S. PATENT DOCUMENTS

| | | | | | |
|---|---|---|---|---|---|
| 2,106,334 | A | * | 1/1938 | Adamson | 2/237 |
| 3,638,242 | A | * | 2/1972 | Herter | 2/237 |
| 3,745,588 | A | * | 7/1973 | Pehle et al. | 2/221 |
| 3,813,698 | A | * | 6/1974 | Campbell et al. | 2/237 |
| 4,244,199 | A | * | 1/1981 | Rhode | 66/193 |
| 4,332,034 | A | * | 6/1982 | Muse | 2/221 |
| 4,720,874 | A | * | 1/1988 | Crawford | 2/221 |
| 4,970,728 | A | * | 11/1990 | D'Ambrosio | 2/220 |
| 5,168,581 | A | * | 12/1992 | Garcia et al. | 2/220 |
| 5,483,702 | A | * | 1/1996 | D'Ambrosio | 2/221 |
| 5,675,842 | A | * | 10/1997 | Schaefer | 2/221 |

FOREIGN PATENT DOCUMENTS

| | | | |
|---|---|---|---|
| WO | 94/28227 | * 12/1994 | D06C/21/00 |

* cited by examiner

*Primary Examiner*—Cheryl A. Juska
*Assistant Examiner*—Lynda Salvatore
(74) *Attorney, Agent, or Firm*—Howard & Howard

(57) ABSTRACT

A method of making a fabric composite capable to assuming a desired shape including the steps of forming an interlining fabric (10) containing elastic yarn (15) running longitudinally of the fabric, varying the density of yarn across the width of the interlining to control the longitudinal extensibility across the width, and attaching the interlining to a fabric backing material (12).

2 Claims, 6 Drawing Sheets

INTERLINING MATERIAL, PROCESS OF MANUFACTURING AND USE THEREOF

CROSS-REFERENCE TO RELATED APPLICATIONS

Not Applicable.

BACKGROUND OF THE INVENTION (1) Field of the Invention

The present invention relates to a method of imparting a desired shape to a piece of fabric and also relates to a resulting fabric composite and to items manufactured therefrom. The composites according to the invention are intended to be made up into such items as waistbands and collars, but the invention is not limited to any particular garment part.

(2) Description of Related Art

Curved waistbands are desirable for the manufacture of certain items of clothing where the waistband is to be sewn to a shaped garment top, but hitherto it has not been possible to manufacture such a curved waistband in a single piece—conventional methods include manufacturing the waistband from several, usually four to six separate pieces sewn together, which is clearly disadvantageous as regards labour and manufacturing costs. Likewise, conventional collars for tailored jackets are manufactured in a number of different pieces to impart the required shape, which is expensive and time-consuming, and, in the case of collars cut on the bias, wasteful of fabric.

BRIEF SUMMARY OF THE INVENTION

It is therefore the aim of the present invention to provide an improved fabric composite and manufacturing method therefor, which overcomes these and other disadvantages.

According to a first aspect of the present invention there is provided a method of imparting a desired shape to a fabric composite, the method including the step of affixing to a fabric backing material an interlining (or interlining composite) having extensibility in the longitudinal direction wherein the method includes the further step of selectively controlling the longitudinal extensibility across the width of the composite in such a manner as to permit the composite to assume, or be formed into, a desired shape.

The term "extensibility" is to be interpreted as meaning the degree to which the interlining or composite may be permanently lengthened (for example by pressing) relative to its original (pre-pressed) length. In this sense, when the longitudinal extensibility is selectively controlled according to the invention, certain areas may subsequently be extended to a greater degree than other areas, resulting in formation of the desired shape.

The manner in which the extensibility is selectively controlled across the composite width is determined by the intended use of the composite.

For example, where the composite is intended to be made into a waistband the area of the composite which will form the upper edge of the waistband is, according to the invention, the area of lower extensibility relative to the area which will form the lower edge of the waistband (to be sewn to the body of the garment), which has higher extensibility. Thus, when the composite so treated is pressed it readily assumes a permanent curved shape in which the lower edge is longer than the upper edge.

On the other hand when the composite is intended to be made into a collar (or collar facing), the area of relatively lower extensibility is in the centre region, with the areas to either side (across the width) having relatively higher extensibility, the composite thus assuming, when pressed, a shape which has longer inner and outer edges relative to the centre region, allowing the inner edge of the collar to be sewn to the garment and the outer edge of the collar when the latter is turned over to lie flat against the garment body.

According to the first aspect of the present invention there is further provided a fabric composite manufactured according to the method of the fourth paragraph hereof.

According to the first aspect of the present invention there is still further provided a collar and/or collar facing manufactured from a fabric composite according to the preceding paragraph.

There are several different ways of achieving the selectively controlled extensibility—one way is to use a single interlining which has the selective control "built in".

According to a second aspect of the present invention there is provided an interlining having indeterminate longitudinal dimension and a width defined by first and second edges, the interlining having extensibility in the longitudinal dimension, wherein the longitudinal extensibility of the interlining varies from the first edge to the second edge. For the manufacture of waistbands, the interlining would be in strip form, in various different widths.

In the case where the interlining strip is of the type having a number of elastic, eg "LYCRA" (Registered Trade Mark) threads running longitudinally, the variation in extensibility is preferably achieved by progressively removing some of the strands, such that the resultant degree of extensibility close to one of the edges is considerably different to that close to the other edge. Alternatively, the interlining could be specifically manufactured to have different densities of such elastic threads across the width of the strip. A further alternative would be to progressively reduce the elastic deniers across the width.

For the avoidance of confusion, the term "elastic" is to be interpreted as meaning the degree of resistance to extensibility, such that high elasticity is to be equated with low extensibility—in the case of the elastic interlining referred to in the preceding paragraph the higher elasticity of one edge resists extension whilst the lower elasticity of the opposite edge allows extension. The term "elastic recovery" refers to the degree to which the composite returns to its relaxed length upon removal of the extending force.

When the interlining is attached to the fabric backing material, typically by conventional fusing methods, the result is a composite strip which has a high degree of elastic recovery at the uppermost edge of the interlining, and a low degree of elastic recovery at the lowermost edge of the interlining, such that the composite assumes, or is made to assume, a curved shape.

During the process of attaching the composite strip to the garment top, the strip may be tensioned through a folding machine such that as the garment emits from the puller feed at the back of the machine the top "high recovery" edge of the resultant waistband recovers, i.e reduces back to its relaxed length prior to tensioning, whilst the lowermost edge of the waistband, which conforms to the shape of the garment top, is unable to recover due to the low elasticity of the interlining in this region, and curvature results, giving a shaped waistband. Steam pressing may be required at this stage to maximise the effect.

According to the second aspect of the present invention there is provided a fabric composite comprising a fabric backing material having affixed thereto an interlining having indeterminate longitudinal dimension and a width defined by first and second edges, the interlining having extensibility in the longitudinal dimension, wherein the longitudinal extensibility of the interlining varies from the first edge to the second edge.

According to the second aspect of the present invention there is further provided a waistband composed of a composite fabric strip comprising a fabric backing material having affixed thereto an interlining of width defined by first and second edges, the interlining having extensibility in the longitudinal dimension, wherein the longitudinal extensibility of the interlining varies from the first edge to the second edge.

Particular advantages ensue if the present invention if the fabric backing material is first subjected to the fabric treatment process described in Applicants' own PCT Patent Application published under number WO 94/28227, according to which a woven fabric is subjected to heat and pressure such that the yarn strands substantially across the width of the fabric are forced closer together, thus imparting a degree of extensibility into the fabric.

In the case where a fabric having very little or no elasticity is used as the backing material, this "pre-treatment" process imparts the necessary degree of stretch, whereas if the fabric used as the backing material has a high degree of stretch, eg "LYCRA" (Registered Trade Mark) fabric, the pre-treatment reduces the resilience of the fabric to a level such that the desired result of the present invention is more satisfactorily achieved than would otherwise be the case. Such pre-treatment to compressively shrink the fabric enables the fabric to be extended at lower loads than prior to compressive shrinking, and many fabrics also tend to increase in length back to or even beyond the original length when steam pressed. Either or both or these effects contribute to the achievement of a curved shape from a straight piece of fabric when the latter is affixed to an interlining of selectively controlled extensibility.

Another way in which the extensibility may be selectively controlled is to use an interlining composite comprising a first interlining of high extensibility combined with a second interlining of relatively lower extensibility, partially overlapping the first interlining in the relevant region—in the case of a waistband, the upper edge and in the case of a collar, in the central region.

For example, an elastic tape or a rigid tape (both of low extensibility) may be fused onto an interlining of higher extensibility interlining, which has the effect, when the composite so formed is pressed, of preventing the upper edge from returning to its original length whilst allowing the lower edge to do so, resulting in a curved shape.

BRIEF DESCRIPTION OF THE SEVERAL VIEWS OF THE DRAWING(S)

Embodiments of the present invention will now be described, by way of example only, with reference to the accompanying drawings, in which:

FIGS. 1 and 1*a* show the interlining with varying elasticity,

DETAILED DESCRIPTION OF THE INVENTION

Figure 1:
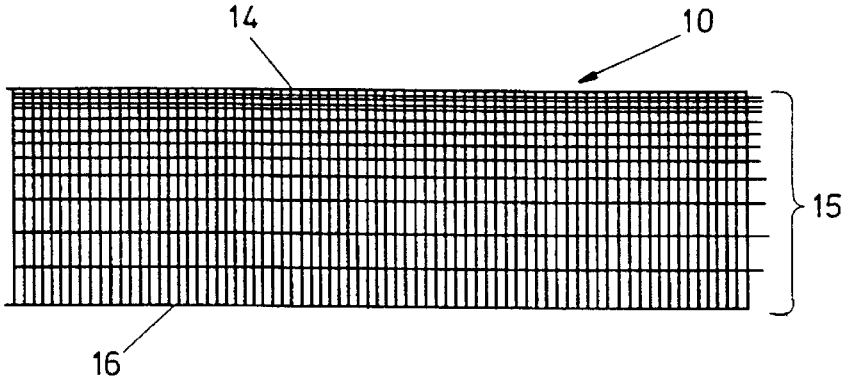
Figure 1A:
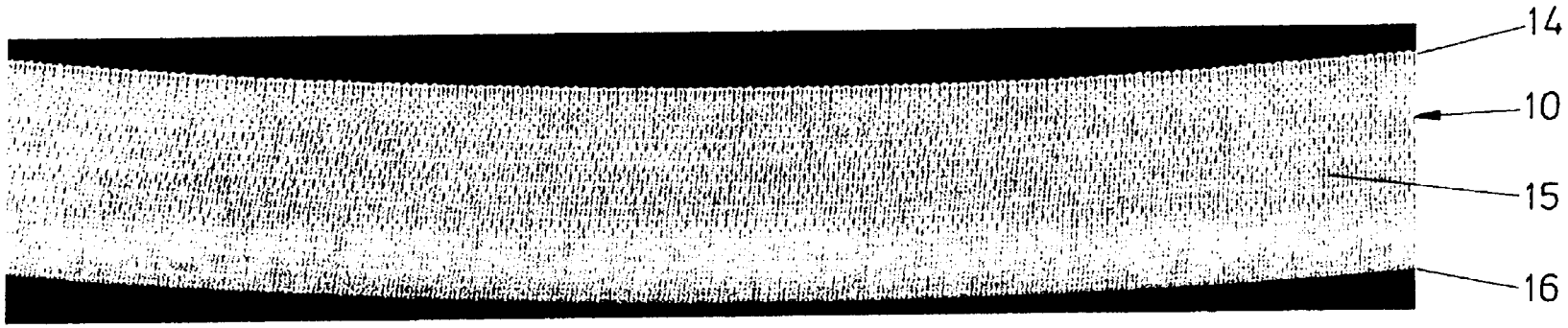

Referring to the drawings, an interlining strip 10 of indeterminate length and a certain width as defined by upper and lower edges 14,16 is of the type which comprises essentially non-elastic vertical strands and elastic, eg "LYCRA" (Registered Trade Mark) strands 15 running longitudinally. In conventional interlining of this type the elastic longitudinal strands are distributed evenly over the width of the strip, but in this embodiment of the present invention, in the interlining strip these elastic strands have been progressively removed and preferably replaced with highly extensible yarns eg. Nylon multifilament (not shown) as illustrated in FIGS. 1 and 1*a*, so that there are fewer strands towards the lower edge 16 and more strands towards the upper edge 14, resulting in an interlining strip which has greater elastic recovery and lower extensibility in its upper region than in its lower region. Replacement of the removed yams with highly extensible yarns enables the interlining to remain stable during subsequent manufacture.

Figure 2:
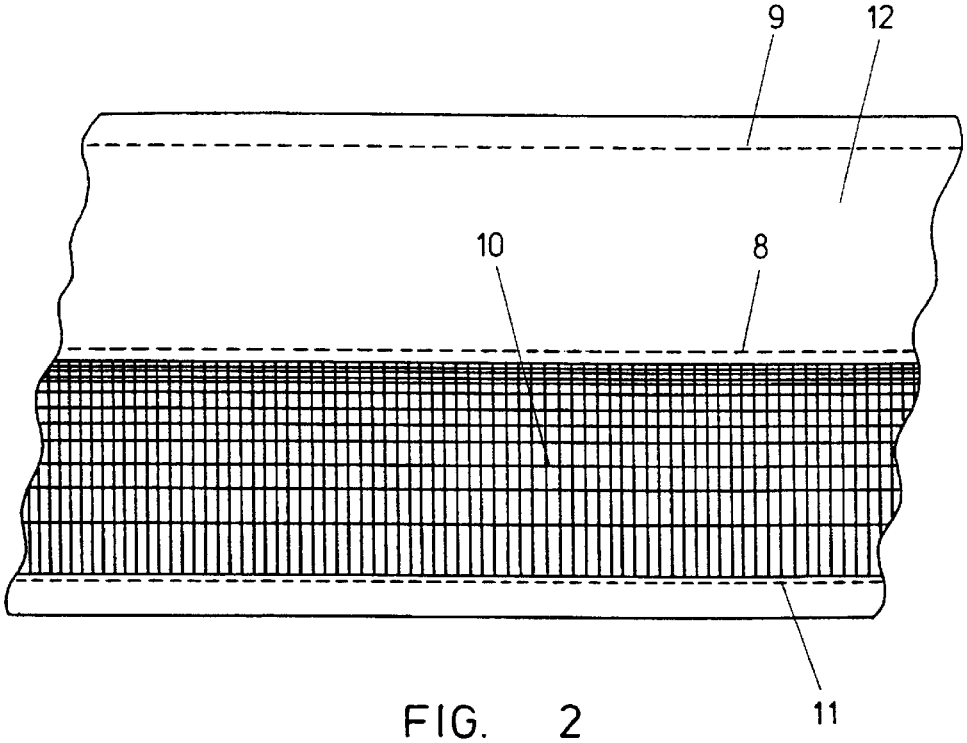
FIG. 2 illustrates a composite strip ready for making up into a waistband
Figure 3:
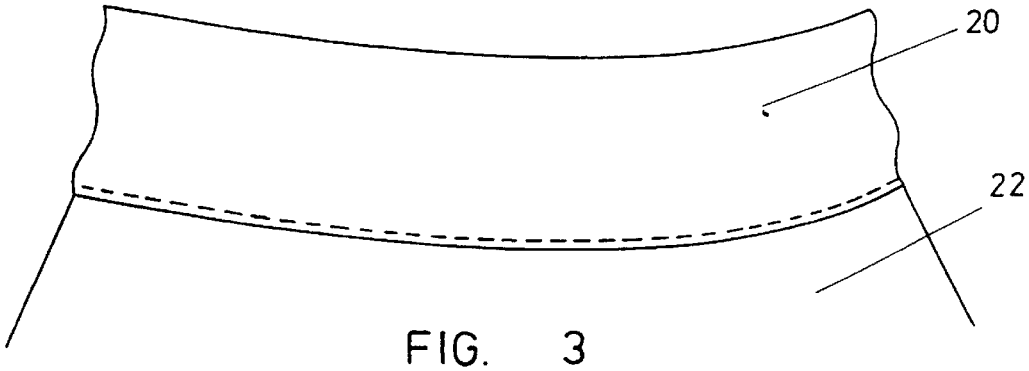
FIG. 3 illustrates the finished waistband, attached to the top of a garment.

Referring now to FIG. 2, (which illustrates the strip prior to tensioning or pressing and hence straight) the interlining strip 10 is placed onto and fused with (by means of fusible adhesive, for example) a fabric backing material 12 cut to just over twice the width of the interlining strip, and the fabric 12 is then folded about fold lines 8, 9 and 11 to form a complete waistband 20. The folding process is preferably carried out simultaneously with the attachment (by sewing, for example) of the waistband 20 onto the upper edge of a garment 22, by feeding the composite, fused strip into a folding machine under tension. Upon exiting the puller feed at the back of the folding machine, the top of the waistband recovers due to the relatively high elasticity of the interlining in this region, whereas the bottom of the waistband is unable to recover due to the low elasticity of the interlining in this region, hence giving rise to a curved waistband as shown in FIG. 3, which conforms to the shape of the upper edge of the garment.

As mentioned previously, where the backing fabric is completely rigid, or conversely is of high elasticity, such as is the case for fabrics containing "LYCRA" (™), the fabric backing 12 is preferably pre-treated with a high temperature compressive shrinking process (as described in WO 94/28227) in order either to impart a degree of extensibility, or to stabilise the elasticity of the fabric, thus contributing to improved performance of the present invention. This imparts to the fabric greater extensibility and also a tendency to return to or beyond the pre-treated length upon steam pressing, which may contribute, to the effect of the present invention, that is to say the formation of a desired shape to a straight (i.e unshaped) piece of fabric.

Figure 4:
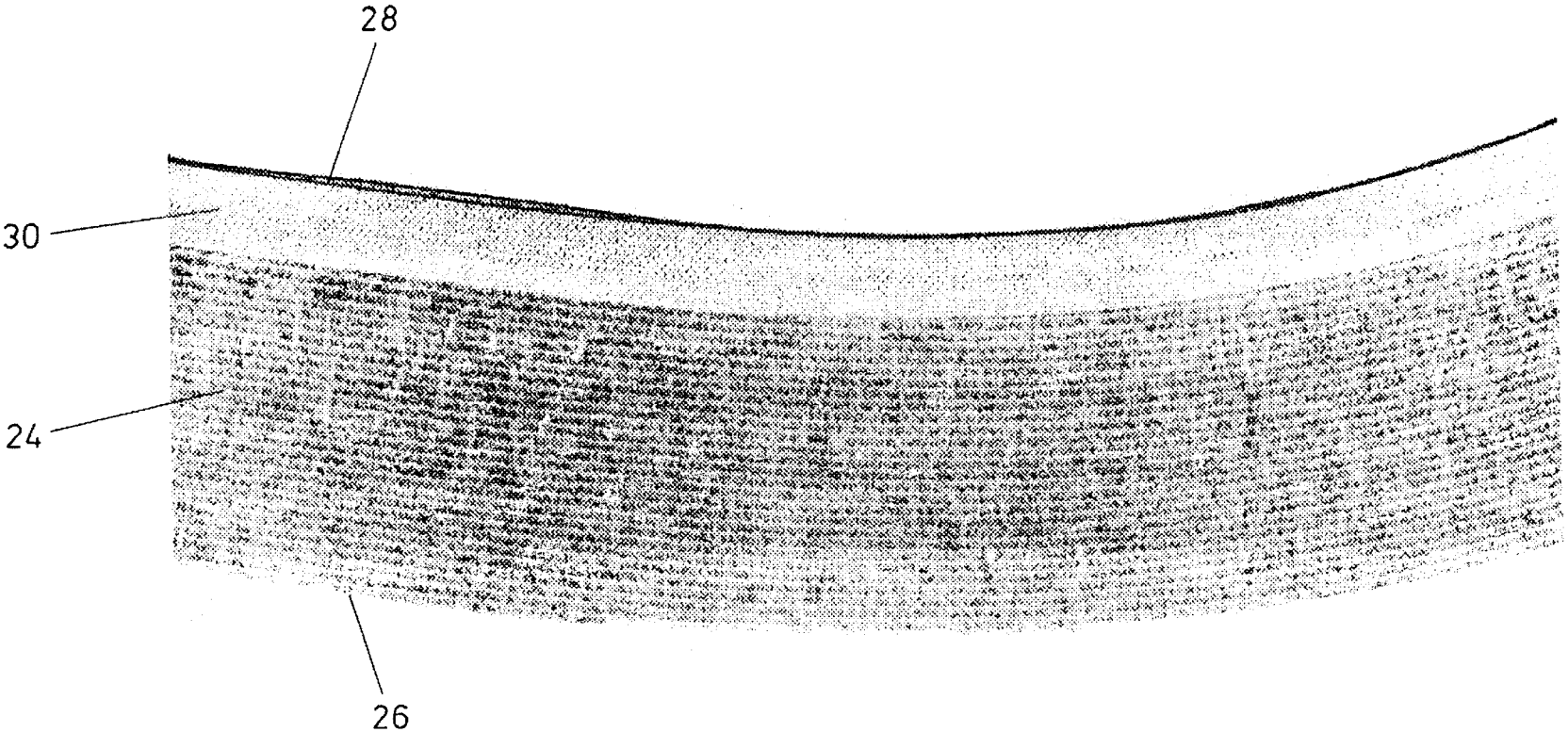
FIG. 4 shows a fabric composite composed of overlapping first and second interlinings.

FIG. 4, shows a waistband facing in which the interlining composite is composed of a first, relatively highly extensible interlining 24 fused to a fabric backing material from the lower edge 26 almost to the upper edge 28. On top of this, in the region adjacent the upper edge 28, there is fused an elastic tape 30 of lower extensibility. Upon steam pressing and/or tensioning this composite, which is intended for use in a waistband, the lower edge 26 is permanently extended whilst the upper edge 28 remains in a contracted condition, by virtue of the elasticity of tape 30, resulting in the curved shape shown.

Figure 5:
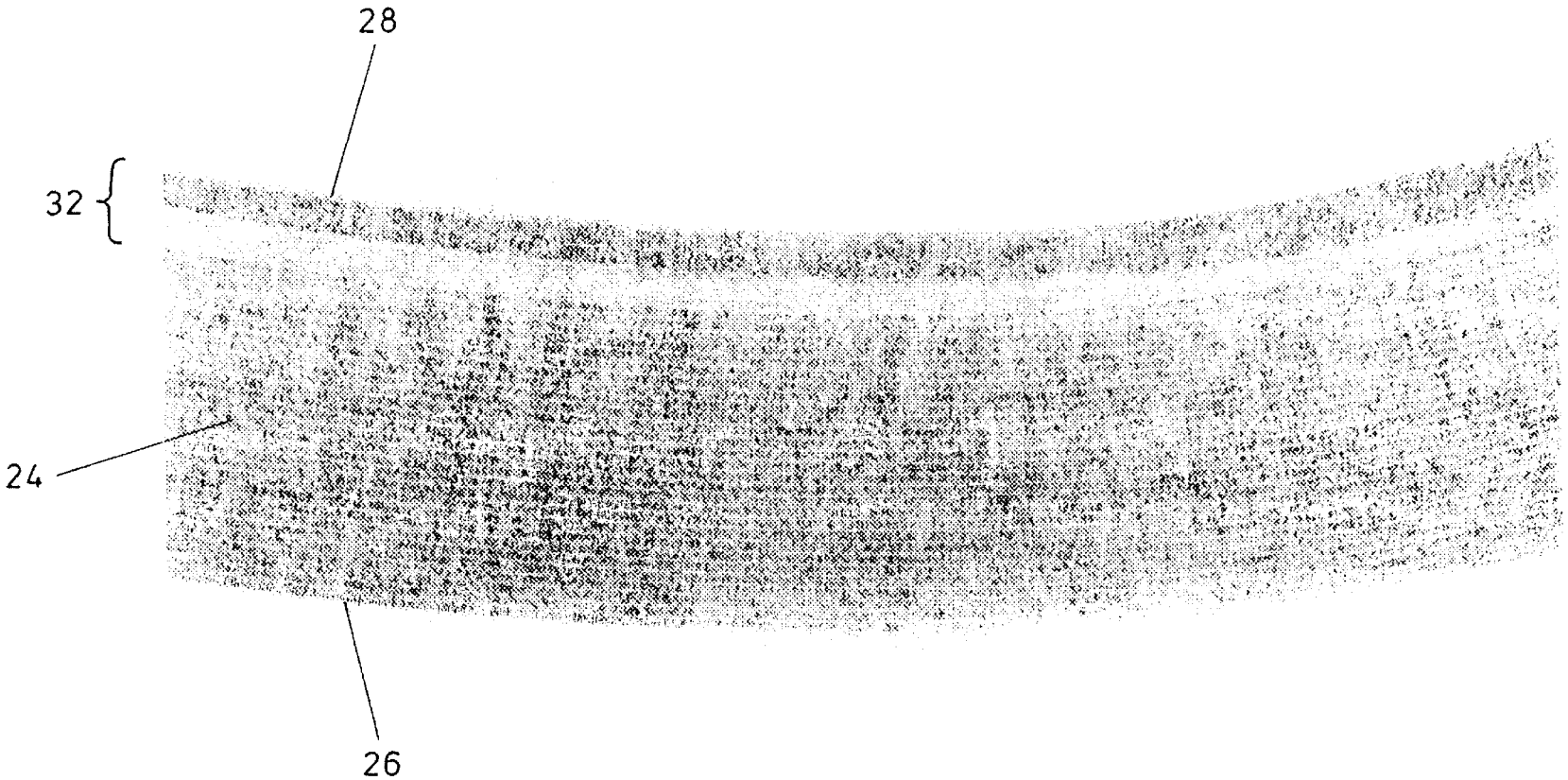
FIG. 5 shows a variant of the composite of FIG. 4, wherein the elastic tape is replace by a rigid tape.

FIG. 5 shows a further waistband facing in which the first interlining 24 is the same as in FIG. 4, but in place of elastic tape 30 there is affixed a rigid tape 32 which, having the same effect of resistance to extensibility as the elastic tape of FIG. 4, again permits a curved shape.

Figure 6:
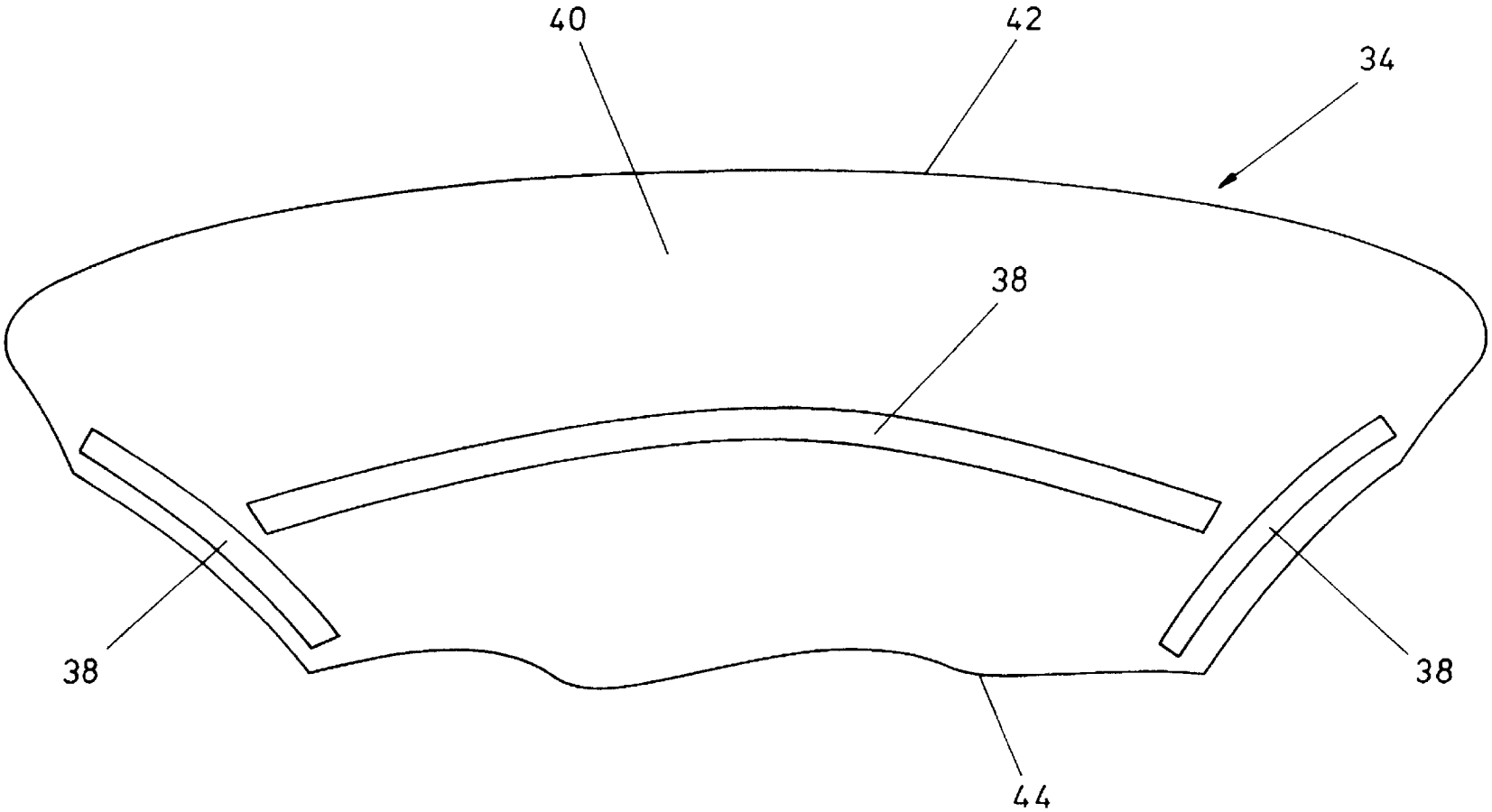
FIGS. 6 and 6*a* show a top collar and under collar according to the invention.
Figure 6A:
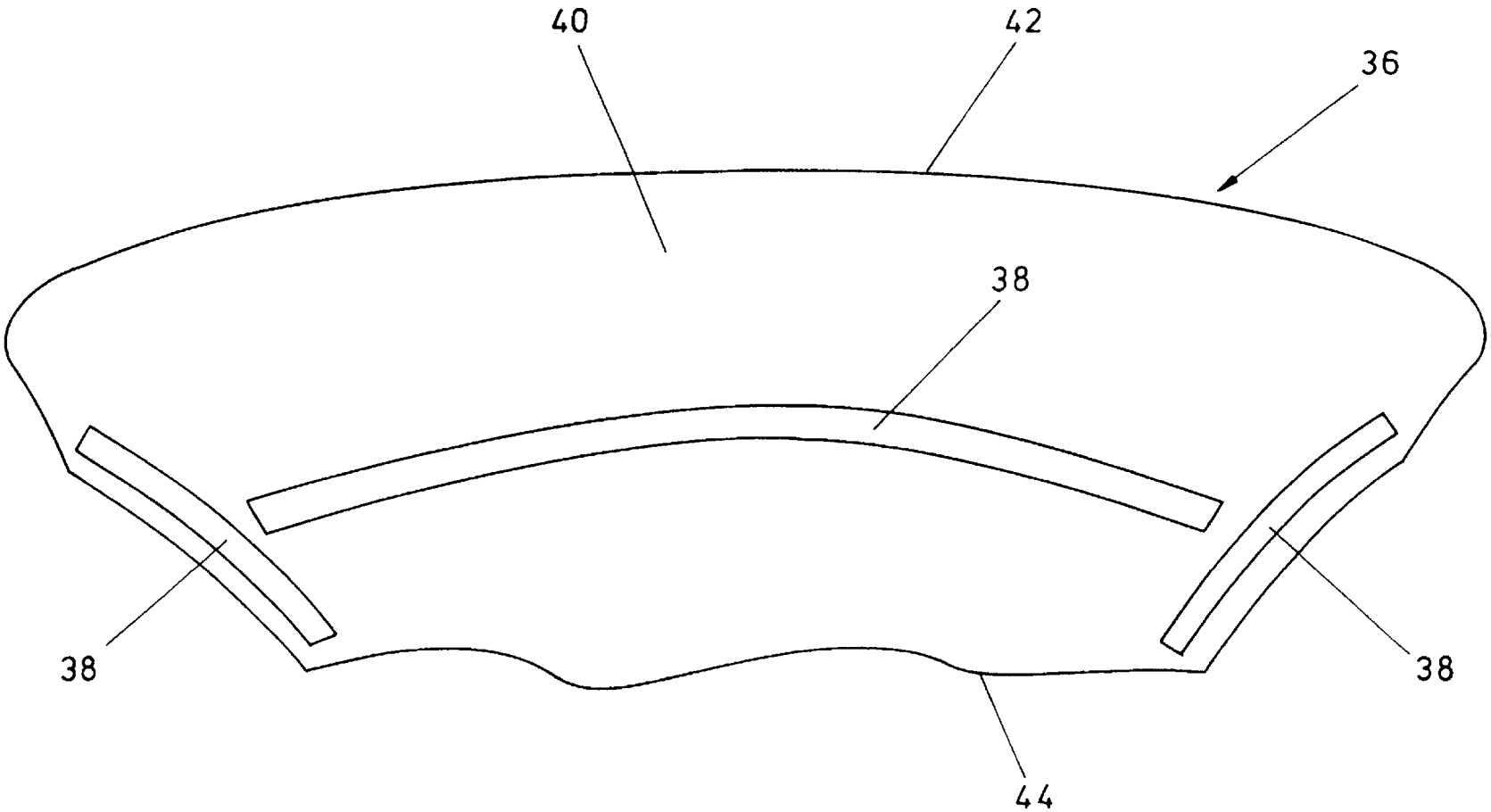

In FIGS. 6 and 6*a* the manufacture of a collar from for example a top collar 34 and under collar 36 is shown. This is on the same principle as that utilised in the waistband strips of FIGS. 4 and 5, in that rigid tapes 38 (second interlining) are fused and/or sewn onto the first interlining 40 of the collar and collar facings, in the desired areas as shown. Thus by restricting extension, upon subsequent pressing, of the central region of the collar relative to the two outer edges 42, 44, the collar can be made to assume a satisfactory shape when attached to the garment and turned over.

What is claimed is:

1. An interlining having indeterminate longitudinal dimension and a width defined by first and second edges, the interlining having extensibility in the longitudinal dimension, wherein the longitudinal extensibility of the interlining varies from the first edge to the second edge, and a number of elastic threads running longitudinally and the variation in extensibility is achieved by reducing the elastic deniers progressively across the width.

2. An interlining having indeterminate longitudinal dimension and a width defined by first and second edges, the interlining having extensibility in the longitudinal dimension, wherein the longitudinal extensibility of the interlining varies from the first edge to the second edge, said interlining having different densities of longitudinal elastic threads across the width of the strip.

* * * * *

US006566285C1

(12) INTER PARTES REEXAMINATION CERTIFICATE (0015th)

United States Patent

Morris et al.

(10) Number: US 6,566,285 C1

(45) Certificate Issued: Feb. 12, 2008

(54) INTERLINING MATERIAL, PROCESS OF MANUFACTURING AND USE THEREOF

(75) Inventors: Paul Morris, Rawdon Leeds (GB); Michael Horsfield, Bardsey Leeds (GB)

(73) Assignee: Pro-fit Holdings Limited, Horsforth, Leeds (GB)

Reexamination Request:
No. 95/000,208, Dec. 20, 2006

Reexamination Certificate for:

| | |
|---|---|
| Patent No.: | **6,566,285** |
| Issued: | **May 20, 2003** |
| Appl. No.: | **09/673,229** |
| Filed: | **Jan. 5, 2001** |

(22) PCT Filed: Apr. 14, 1999

(86) PCT No.: PCT/GB99/01146

§ 371 (c)(1),
(2), (4) Date: Jan. 5, 2001

(87) PCT Pub. No.: WO99/52386

PCT Pub. Date: Oct. 21, 1999

(30) Foreign Application Priority Data

Apr. 15, 1998 (GB) ..... 9807861

(51) Int. Cl.

| | |
|---|---|
| ***A41B 3/00*** | (2006.01) |
| ***A41B 3/10*** | (2006.01) |
| ***A41D 27/06*** | (2006.01) |
| ***A41D 27/02*** | (2006.01) |
| ***A41F 9/00*** | (2006.01) |
| ***A41F 9/02*** | (2006.01) |

(52) U.S. Cl. ..... 442/184; 442/182; 442/328; 442/366; 442/329; 442/183

(58) Field of Classification Search ..... None
See application file for complete search history.

(56) References Cited

U.S. PATENT DOCUMENTS

| | | | |
|---|---|---|---|
| 1,884,310 | A | 10/1932 | Sime |
| 2,106,334 | A | 1/1938 | Adamson |

FOREIGN PATENT DOCUMENTS

| | | |
|---|---|---|
| WO | WO/94/28227 | 12/1994 |

*Primary Examiner*—Stephen Stein

(57) ABSTRACT

A method of making a fabric composite capable to assuming a desired shape including the steps of forming an interlining fabric (10) containing elastic yarn (15) running longitudinally of the fabric, varying the density of yarn across the width of the interlining to control the longitudinal extensibility across the width, and attaching the interlining to a fabric backing material (12).

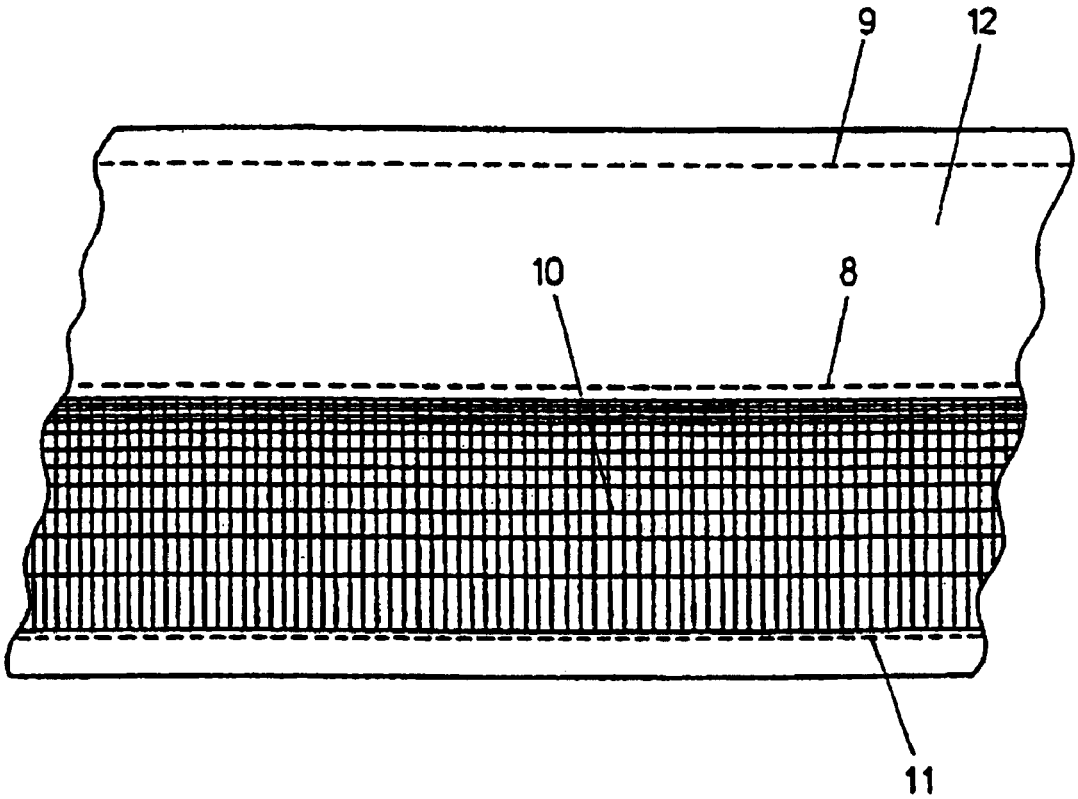

INTER PARTES REEXAMINATION CERTIFICATE ISSUED UNDER 35 U.S.C. 316

THE PATENT IS HEREBY AMENDED AS INDICATED BELOW.

AS A RESULT OF REEXAMINATION, IT HAS BEEN DETERMINED THAT:

Claims 1 and 2 are cancelled.

* * * * *